US006392601B1

(12) United States Patent
Ku et al.

(10) Patent No.: US 6,392,601 B1
(45) Date of Patent: May 21, 2002

(54) RECEIVING AND TRANSMITTING DEVICE OF ANTENNA

(75) Inventors: Kao-Tong Ku, Hsin Chu; Chieh Yang, Yeong-Her, both of (TW)

(73) Assignee: Pro Broadband Inc., Hsin Chu (TW)

( * ) Notice: Subject to any disclaimer, the term of this patent is extended or adjusted under 35 U.S.C. 154(b) by 0 days.

(21) Appl. No.: 09/816,310

(22) Filed: Mar. 26, 2001

(51) Int. Cl.[7] ..... H01Q 13/10
(52) U.S. Cl. ..... 343/700 MS; 343/846
(58) Field of Search ..... 343/700 MS, 702, 343/791, 846; 342/357; 701/213

(56) References Cited

U.S. PATENT DOCUMENTS 5,831,577 A * 11/1998 Nichols et al. ..... 342/357
6,307,520 B1 * 10/2001 Liu ..... 343/767

* cited by examiner

*Primary Examiner*—Don Wong
*Assistant Examiner*—James Clinger
(74) *Attorney, Agent, or Firm*—Rabin & Berdo, P.C.

(57) ABSTRACT

The present invention provides a receiving and transmitting device of antenna, which consists of an intermediate layer located at a grounded plane of a PC board and a grounded plane of a patch antenna to connect and to form a grounded condition. An electric conductor is able to be penetrated the PC board through the intermediate layer and the patch antenna, and respectively connecting with radiant element and PC layer adapted for a filled insulator to form a structure of coaxial cable for utilizing in receiving with less loss and transmitting with higher power of microwave signals. The invention is also very easy in fabricating and producing.

15 Claims, 7 Drawing Sheets

RECEIVING AND TRANSMITTING DEVICE OF ANTENNA

TECHNICAL FIELD

The present invention relates to an antenna, especially an improved antenna device, which has an electric conductor to penetrate a patch antenna through an intermediate layer and a PC (printed circuit) board to respectively connect with radiant elements and a PC layer for receiving and transmitting high power microwave signals.

BACKGROUND OF THE INVENTION

A conventional antenna used by a metal radiant element connected with a flexible cable. One end of the cable conjoins to a terminal of a PC board, and the other end of the cable conjoins to a feeding terminal of a patch antenna. For the patch antenna to receive/transmit microwave signals in different directions, generally, the users have to adjust not only the directions of the antenna, but also its angels of elevation (as shown in FIG. 1). Usually, a rotating element 12 and a deflecting element 13 are designed to accommodate a cable 10 inside their hollow spaces. Said a deflecting element 13 is connected and supported the patch antenna 11 and a rotating element 12 is on the axis pivot of the housing. Thus, the cable 10 is able to penetrate the rotating element 12 through the deflecting element 13 and to connect with the patch antenna 11. Due to constantly rotate and regulate the antenna's directions and elevation angles for receiving and transmitting a better quality of microwave signals, the connection of rotating element 12 will be fallen off and loosen easily from the cable 10. Understandably, the rotating element 12 cannot secure hold on the cable 10, which shall cause to worse signals in receiving and transmitting. Moreover, for transmitting microwave signals onto a rather long cable, a thermoelectric effect will occur herein, the heat generated which will be accumulated in the cable 10, and will cause increments of both of intrinsic resistance and thermal noise of the cable 10. In addition, for receiving microwave signals with a rather long cable, extra signal loss is being generated. Finally, the whole system's performance is degraded.

Furthermore, the patch antenna uses a deflecting element connects with a rotating element for rotating the antenna. For the rotating element is connected with the cable that leads to difficult in assembling and to inefficient in mass-production processing, as well as the rotating element will be fallen off from the cable easily. Those are vulnerable to the conventional one been manufactured/manufacturing and utilized/utilizing by the makers and users. So those defectivenesses have to be improved by the antenna makers The inventor of the present invention has been developing and improving to the industry in receiving and transmitting devices of antennas for a very long term. With his accumulated experience and knowledge to devote in manufacture and design of antennas and peripheral products, so an antenna can be very convenient rotated directions and angles by connected with a PC board for receiving/transmitting (R/T) microwaves and signal data is developed and invented.

SUMMARY OF THE INVENTION

The principle object of the present invention of R/T device of antenna is related to the structure arrangement among a PC board, an intermediate layer with a through hole, an electric conductor and a patch antenna to replace a traditional coaxial cable used in conventional antenna with better performance.

The intermediate layer itself is a good conductive plate and there is a through hole on it. The ground layer of the PC board is contacted on one side of the intermediate layer, while the ground layer of the patch antenna is contacted on the other side of the intermediate layer. By making the signals terminal of PC board and the feeding terminal of the patch antenna collocated to the through hole of the intermediate layer, and then connect them with the ends of the through-going electric conductor respectively, the signal path is built. The inner sidewall of the through hole of the intermediate layer and the electric conductor form a basic structure of a coaxial cable. Insulator material is filled optionally into the through hole of the intermediate layer to accommodate the electric conductor fly. The loss is less than the traditional coaxial cable due to smaller thickness of the intermediate layer than the cable length and the heat generated is sunk by the intermediate layer quickly.

The second object of the present invention of R/T device of antenna is related to the structure arrangement among a PC board, an intermediate layer with a through hole, an electric conductor and a patch antenna, by making the signals terminal of PC board and the feeding terminal of the patch antenna collocated to the through hole of the intermediate layer, with an electric conductor penetrated them to build the signals' path, can be fabricated very fast and easy.

DESCRIPTION OF DRAWINGS

In order to detailed describe the purposes, characteristics and functions of the present invention, some examples of embodiment and figures relate to the present invention as following:

BRIEF DESCRIPTION OF THE DRAWINGS

Figure 1:
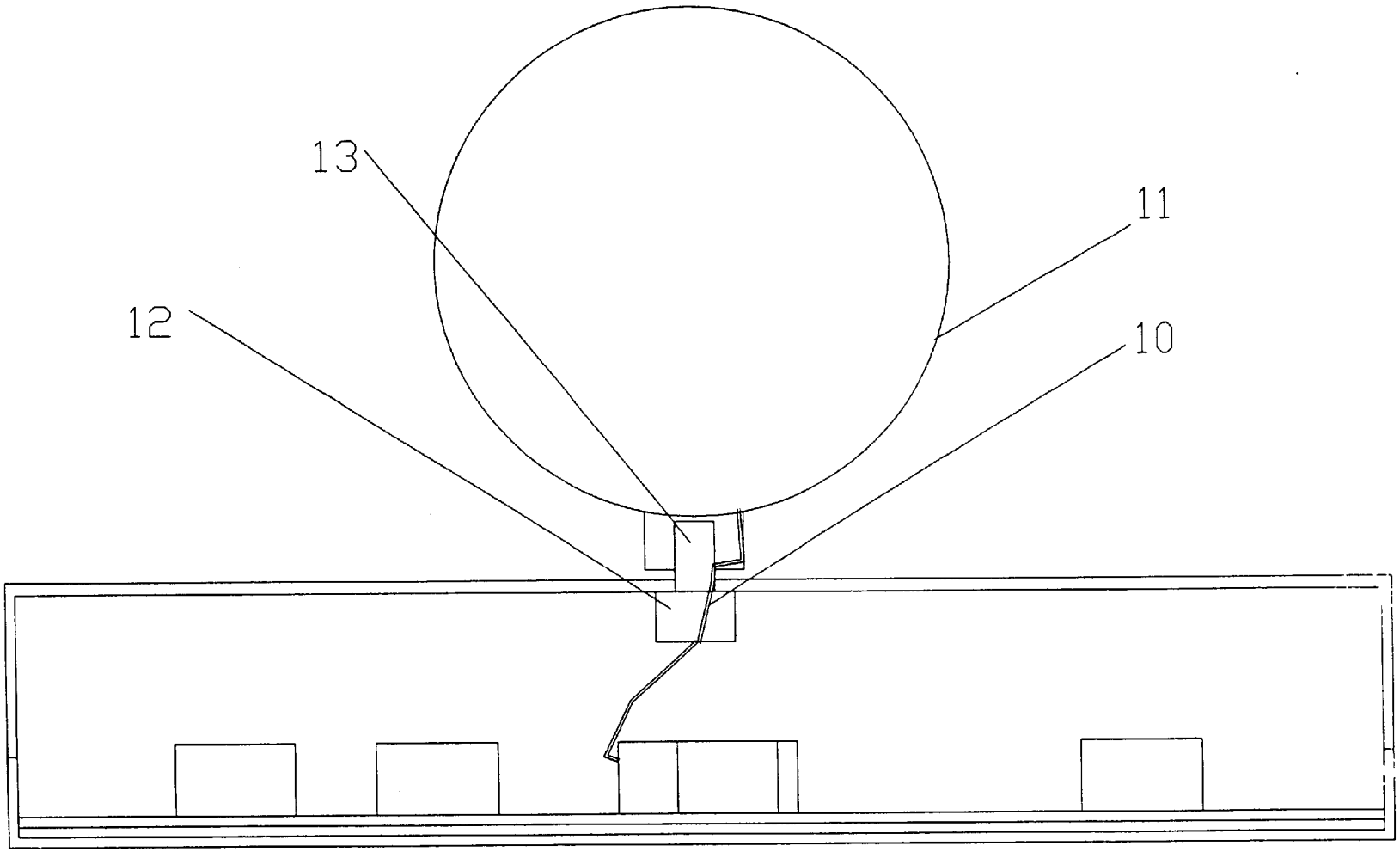
FIG. 1 PRIOR ART

FIG. 1 is a diagramatic sketch illustrates a conventional patch antenna, of its cable penetrates a rotating element through h a deflecting element, and then connects with the patch antenna.

Figure 2:
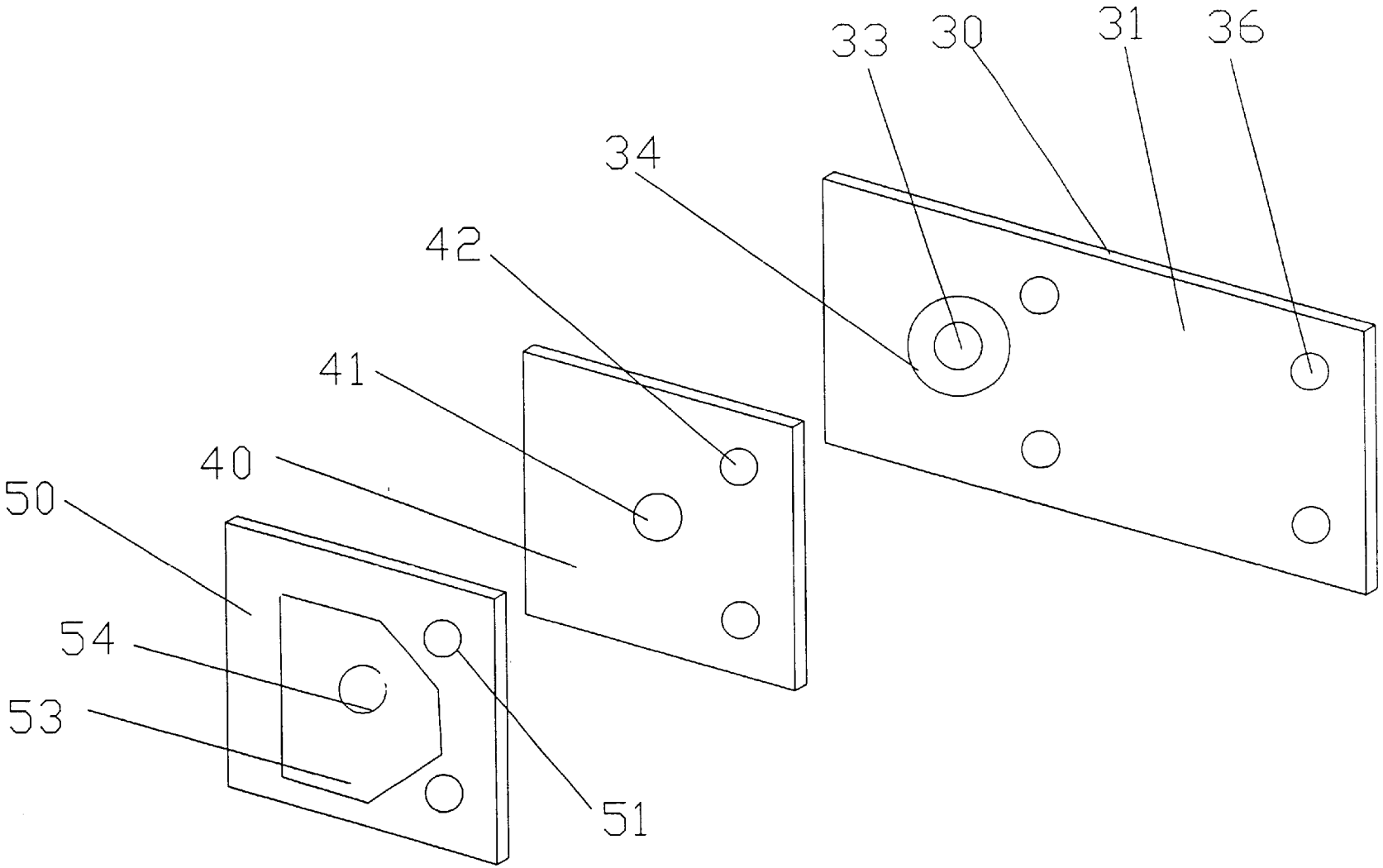

FIG. 2 is a diagrammatic sketch illustrates a patch antenna of the present invention.

Figure 3:
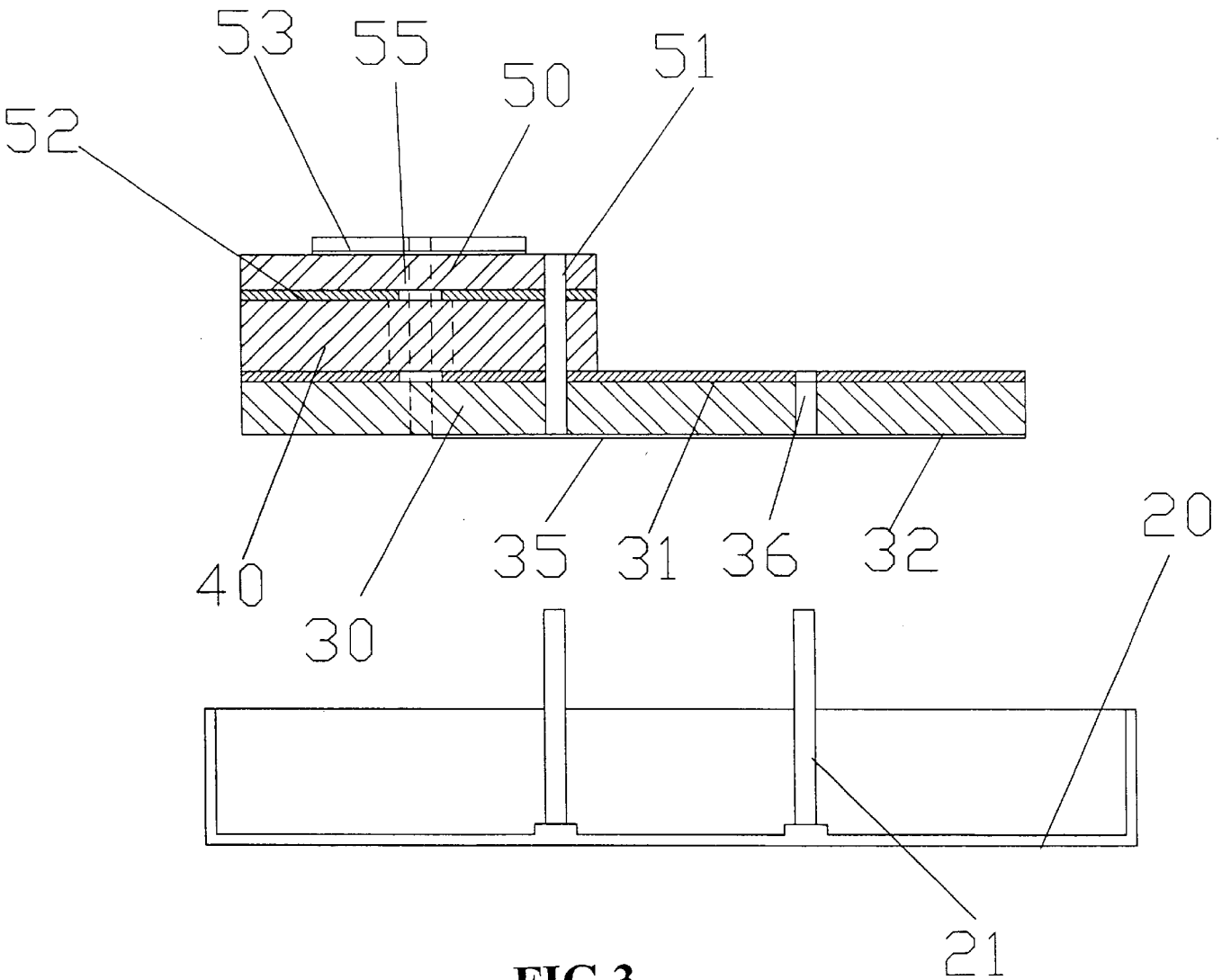

FIG. 3 is a diagrammatic sketch illustrates the invention's assembly and fabrication.

Figure 4:
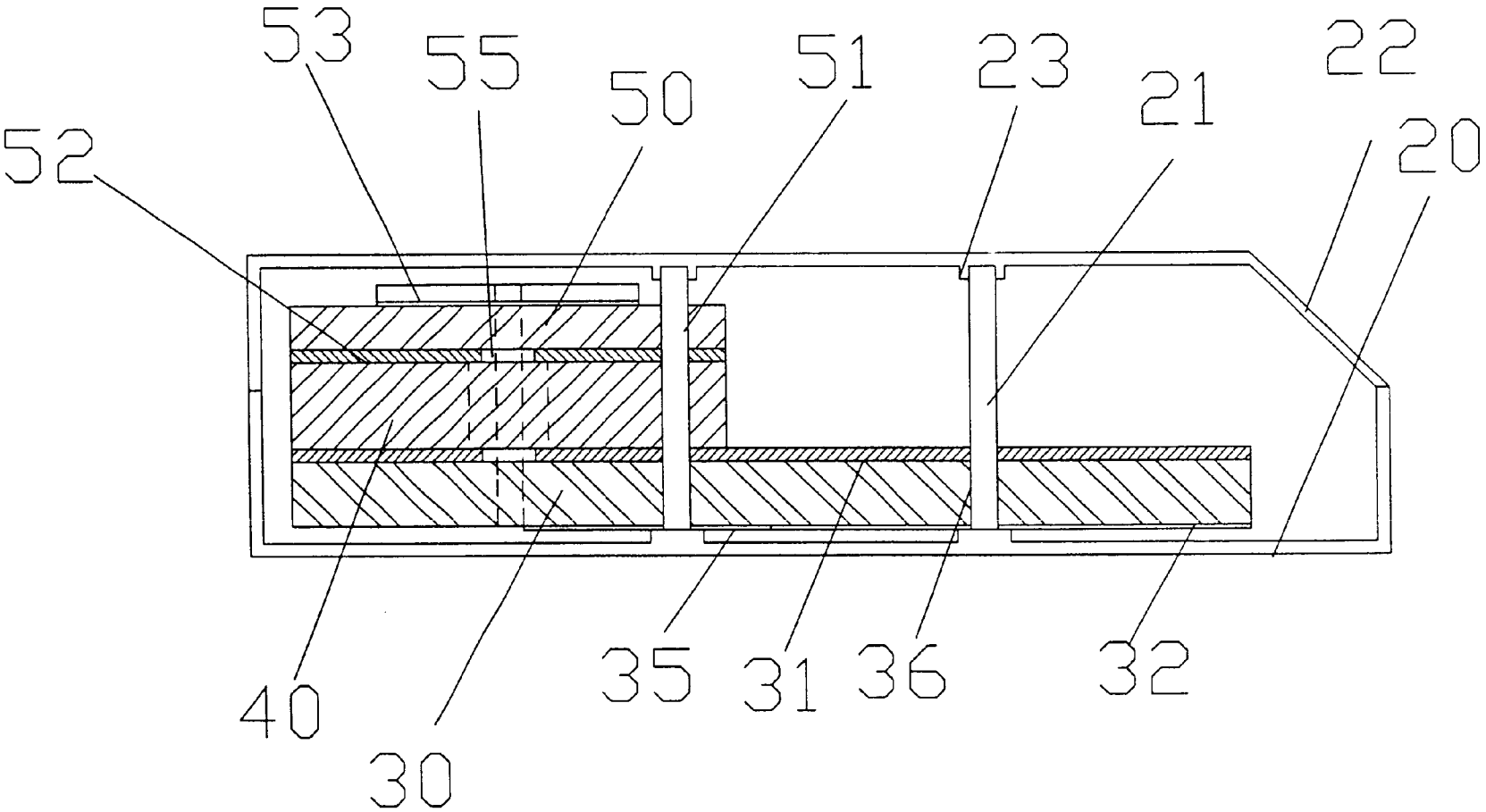

FIG. 4 is a sectional diagram illustrates an approach of the invention in assembling a patch antenna and housing.

Figure 5:
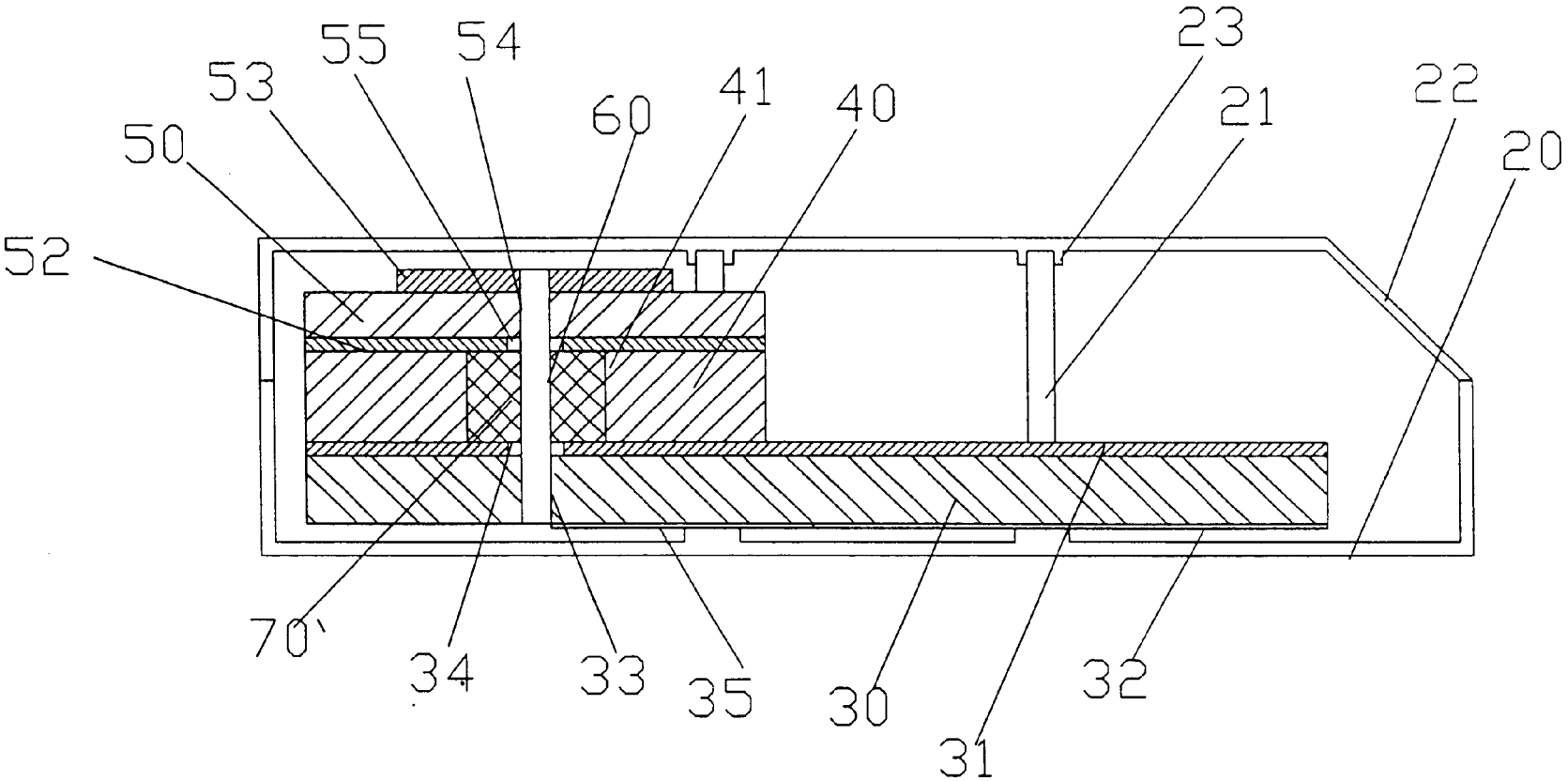

FIG. 5 is a sectional diagram illustrates the invention's partial assembly.

Figure 6:
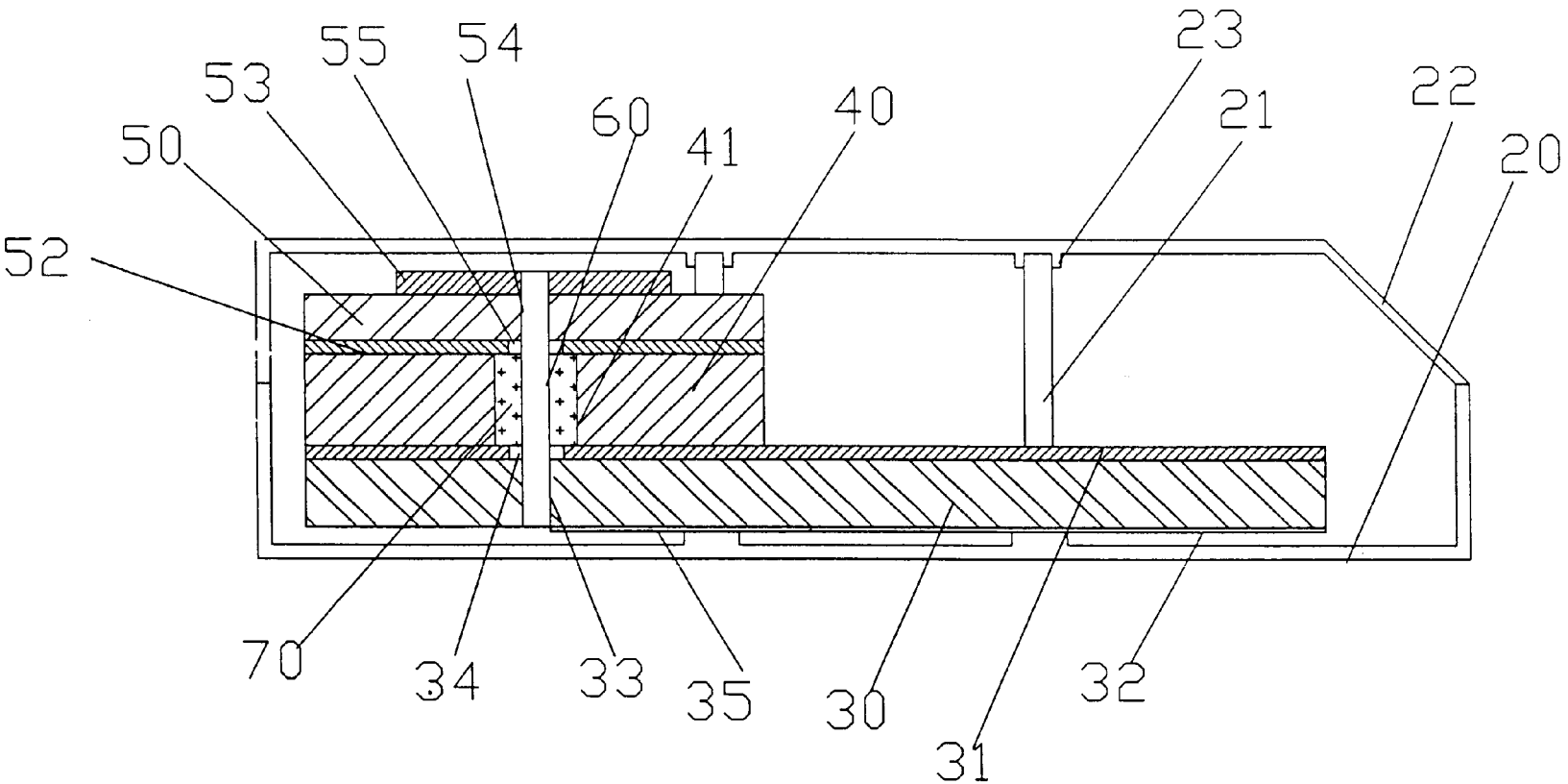

FIG. 6 is a partial sectional diagram illustrates the second example of the invention to show a through hole of the intermediate layer filled with TEFLON.

Figure 7:
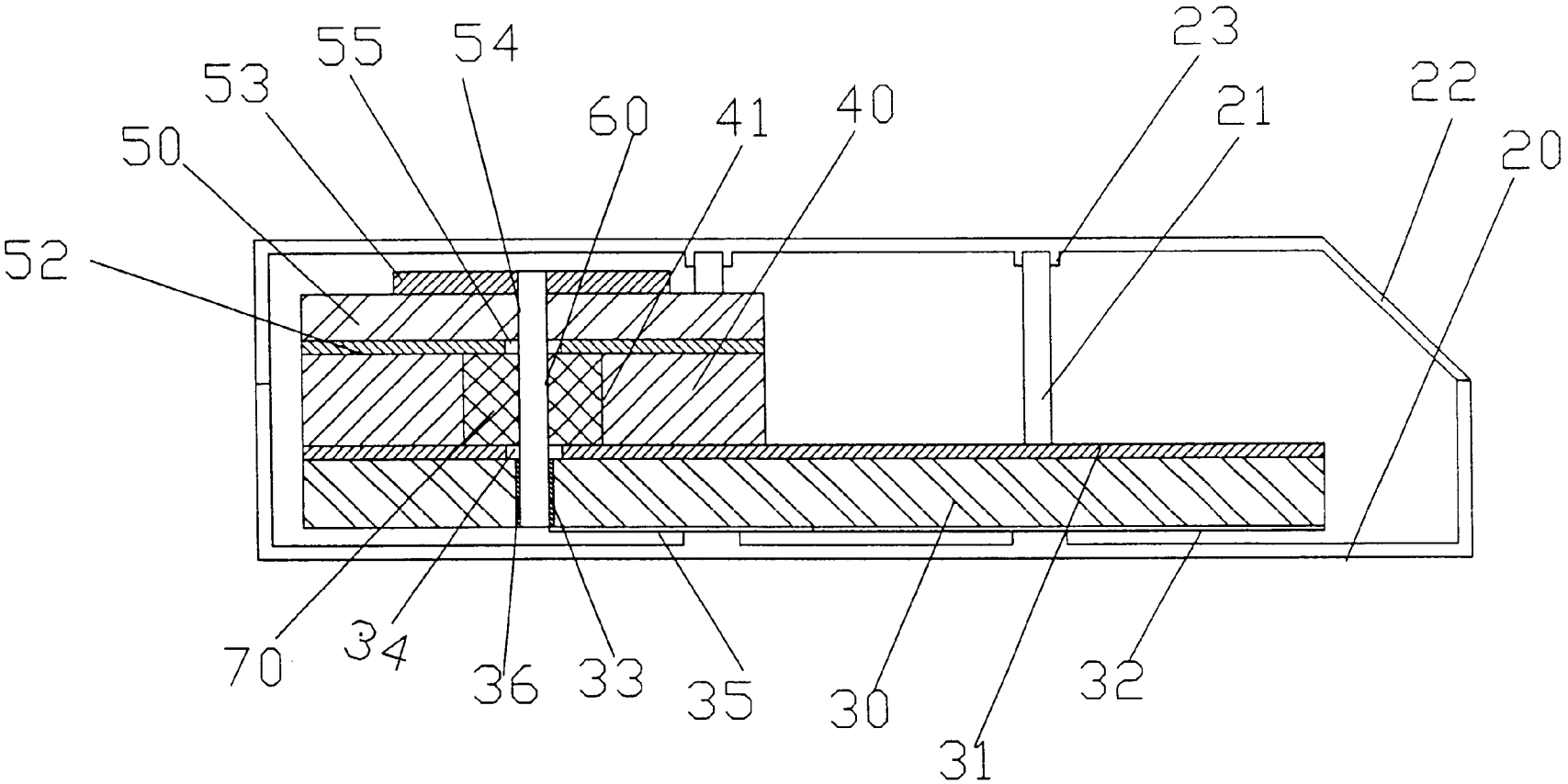

FIG. 7 is a diagram illustrates the third example of the invention to show in assembling of a PC board and an electric conductor.

DESCRIPTION OF TERMS

| | | | |
|---|---|---|---|
| 10 | cable | 11 | patch antenna |
| 12 | rotational component | 13 | deviated element |
| 20 | housing | 21 | positioning bar |
| 22 | cover | 23 | fixing sheath |
| 30 | PC board | 31 | grounded plane of PC board |
| 32 | PC layer | 33 | feed hole |
| 34 | annular recess | 35 | transmission line |

-continued

| | | | |
|---|---|---|---|
| 36 | round hole | 37 | contact surface |
| 40 | intermediate layer | 41 | dimension through hole |
| 42 | round hole | 50 | patch antenna |
| 51 | round hole | 52 | grounded plane of patch antenna |
| 53 | radiant element | 54 | feed hole |
| 55 | circular groove | 60 | electric conductor |
| 70' | filled insulator | 70 | filled insulator |

DETAILED DESCRIPTION OF THE INVENTION

With refer to FIG. 2, 3, 5 and 6. The first example of the invention consists a housing 20, a PC board 30, an intermediate layer 40, a patch antenna 50, an electric conductor 60 and a filled insulator 70. For the housing 20 is made of non-interfere-microwave-signal materials (shown in FIG. 3 and FIG. 4), a suitable space in the housing 20 for placing four positioning bars 21 and a cover 22 to cover the housing 20; and four fixing sheaths 23 to match the positioning bars 21 correspondingly.

With refer to FIG. 2, 3, and 5. The PC board 30 can be used in multi-layer PC boards structure in the present invention, is a double-layer one. One side of its upper layer is covered with a grounded plane 31, which is made of electric conductivity materials and is connected to ground potential. A PC layer 32 is allocated on the other side of the board 30 for mounting electric components. A feed hole 33—as a signal terminal—on the PC board 30 corresponding conjoins with the PC layer 32. A space between the feed hole 33 and the grounded plane 31 is completely etched and formed an annular recess 34. For the recess 34 is a non-conductive electricity area and there is an appropriate allowance space between the feed hole 33 and the grounded plane 31. A transmission line 35 is set on PC board 30 to connect the feed hole 33 and PC layer 32 electrically. The invention uses a microstrip line as a transmission line. Four holes 36 on the PC board are set to match the positioning bar 21 correspondingly.

With refer to FIG. 2 and 3. The intermediate layer 40 is good in electric conductive with a proper superficial area and thickness, which is also good in heat conductive. The materials of the intermediate layer 40 are made of a 3mm-thick aluminum board. One side of the intermediate layer 40 connects with the grounded plane 31 of the PC board 30 bilaterally to form a widely contact area and equal electrical potential. A through hole 41 with a proper dimension located at the intermediate layer 40 is against to the feed hole 33 on the PC board 30 correspondingly. Besides, two round holes 42 set on the intermediate layer 40 are against to two round holes 36 of the PC board 30 accordingly.

With refer to FIG. 2 and 5. The patch antenna 50 is corresponding against to the intermediate layer 40—presented an equal area of them, seemly—, of two round holes 51 on the patch antenna 50 are against to two round holes 42 on the intermediate layer 40. A grounded plane 52 is set at the bottom of the patch antenna 50, of the materials of the grounded plane 52 are electric conductive metal—copper is used in the present invention. The grounded plane 52 conjoins the intermediate layer 40 bilaterally to form an appropriately contact area facially. A feed hole 54—as a signal feeding terminal to the radiant element (s) 53—penetrates the patch antenna 50 to reach the grounded plane 52. A space to adjoin the feed hole 54 and the grounded plane 52 is completely etched to form a circular groove 55. Of the feed hole 54 and the ground flat 52 are formed an appropriate allowance isolative space.

With refer to FIG. 3 and 5. The electric conductor 60 is a metal pin with a good conductive property and a proper length and diameter. For the feed hole 33 of the PC board 30, the through hole 41 of the intermediate layer 40 and the feed hole 54 of the patch antenna 50 are penetrated by the conductor 60. Of one end of the conductor 60 connects with the feed hole 54 of the patch antenna 50, and the other end connects with the transmission line 35 of the PC board 30 to establish the signals' path.

With refer to FIG. 5 and 6. The filled insulator70 is filled into the through hole 41 to accommodate the electric conductor 60, of the conductor 60 is formed as an insulator to insulate the electric conductor 60 from the intermediate layer 40.

According to above description of the structure, the assembly procedures are stated as following. The grounded plane 52 of the patch antenna 50 is attached onto the top plane of the intermediate layer 40 first. Then, taking the PC layer 32 of the PC board 30 downward, attach the grounded plane 31 of the PC board 30 onto the bottom plane of the intermediate layer 40. And soon, aligning three groups of round holes 36, 42, 51 of PC layer 32 to correspondingly match the positioning bar 21 of the housing 20. Thus the PC board 30, the intermediate layer 40 and the patch antenna 50 are stacked and sheathed into the housing 20 to form a fixed assembly. The locations of the feed hole 33 of the PC board 30, the through hole 41 of the intermediate layer 40 and the feed hole 54 of the patch antenna 50 are intentionally designed to align each other on the direction perpendicular to the PC board's 30 plane. Such that, the electric conductor 60 can be easily penetrated the PC board 30, the intermediate layer 40 and the patch antenna 50 through the feed hole 33, the through hole 41 and the feed hole 54, respectively. By soldering the two ends of the electric conductor 60 to connect the feed hole 33 and feed hole 54 correspondingly, the microwave signal path are built with the equivalent coaxial cable structure.

These above stated procedures can be more convenient for assembling and can avoid conventional complicated procedures in wire cables' connection. Thus, the assembled PC board 30, intermediate layer 40 and patch antenna 50 is completely finished, and is to be sturdily jointed together as a whole, and is able to be placed at anywhere else. Furthermore, this kind of assembly is more convenient to decrease labor costs and to improve those defectivenesses of connection between deviated and rotational elements than the conventional one.

With refer to FIG. 5. Have the conductor 60 penetrate through the feed hole 33 of the PC board 30 for separating to the grounded plane 31 by the annular recess 34 and its inter rim is completely etched. Thus the conductor 60 and the grounded plane 31 shall be disconnected. Similarly, have the conductor 60 penetrate through the feed hole 54 of the patch antenna 50 for separating to grounded plane 52 by the circular groove 55 and its inter rim is completely etched. Thus, one end of the conductor 60 shall connect with the PC layer 32 of the PC board 30, and the other end shall connect with the radiant element 53 of the patch antenna 50. Simultaneously, have the conductor 60 penetrate through the through hole 41. Thus, the outer surface of the conductor 60 is covered with the filled insulator 70 to corresponding match the intermediate layer to form an equivalent structure of coaxial cable.

The radius of through hole 41 is 2.7 mm and the diameter of conductor 60 is 1.2 mm in the invention. The air is the material of the filled insulator70, and is already existed inside the empty space between through hole 41 and conductor 60. The air—as an dielectric medium—makes the characteristic impedance of the formed equivalent coaxial cable close to 50 ohrns.

An effect of heat loss shall be occurred during the electric conductor 60 in transferring electric waves, and the heat shall transfer onto the surrounding of conductor 60. The same as in transferring microwaves in the PC layer 32 and radiant element 53, as the heat is generated, the generated heat shall transfer onto the PC board 30, patch antenna 50 and electric conductor 60. Namely, for the grounded plane 31 of PC board 30 and the grounded plane 52 of patch antenna 50 are face-face contacted with the intermediate layer 40. For the intermediate layer 40 is made of aluminum materials, a good effect of conduction of heat, so the layer 40 can conduct the heat. Additionally, the heat generated from microwaves' transferring, also, is conducted out rapidly and massively. Thus, the present invention can sink the heat out, and can transfer higher microwave power.

The second practical example of the invention is very similar to the first example. With refer to FIG. 6. The differences between them are: The through hole 41 of intermediate layer 40 is filled with the filled insulator70' in example two, of the insulator70' is made of polytetrafluoroethylene—so called Teflon in general. The radius of through hole 41 is 4.0 mm and the diameter of conductor 60 is 1.2 mm in the invention. For the Teflon is a feature in attenuate small ratio of microwave power, and have the filled insulator70' with Teflon been injected into an empty space between through hole 41 and electric conductor 60. The Teflon—as a dielectric medium—is filled with the empty space for utilizing in high frequency or wide band microwaves. Moreover, the outer edge of conductor 60 is wrapped with Teflon and formed a firmly staff, and the conductor 60 can be against to the through hole 41 in geometric position precisely to form an inner conductor of the equivalent coaxial cable. So, the effect of receiving and transferring in electric conductor's 60 microwave-transmission shall promote.

The third practical example of the present invention is very similar to the first and second example. With refer to FIG. 7. The differences among them are: The inner rim in feed hole 33 of PC board 30 is plated by good conductive materials, contact surface 37. For the contact surface 37 connects with the transmission line 35 to conduct the PC layer 32 and the surface 37 is fully located on the inner rim of feed hole 33, so have the surface 37 adapt with the electric conductor 60 to penetrate feed hole 33. Thus, the conductor 60 can total contact with the surface 37 and can easy to match the geometric center. Especially, the through hole 41 is filled with Teflon and the outer surface of electric conductor 60 is also wrapped with Teflon, of them shall be formed a fixed position. Have the electric conductor 60 sheathe into the feed hole 33 to ensure in contacting the contact surface firmly, the conductor 60 can easy match with the geometric center of the through hole 41. So, the effect of receiving and transferring in electric conductor's 60 microwave transmission shall raise, which is suitable for transmitting high power of high frequency or wide band microwaves.

In summary of above all: The present invention, receiving and transmitting device of antenna, of which the grounded plane of PC board, intermediate layer and grounded plane of the patch antenna are connected to form a grounded potential. And have the electric conductor penetrate PC board through intermediate layer to reach patch antenna, also, respectively connect with radiant element and PC layer to form a feature of coaxial cable, which can transfer heat, receive and transmit high power microwave signals. Furthermore, the simplified structure is able to assemble in convenient and produce in practicable. For the invention can be utilized in industrial and is a pioneer creation in novelty, which shall meet the requirements of invention patent.

What is claimed is:

1. A receiving and transmitting antenna device, comprising:

a printed circuit board having a first side on which is formed a ground plane comprised of an electrically conductive material, and a second side on which is formed a printed circuit layer to which circuit elements are connected, the printed circuit board having a feed hole at a fixed position thereon;

an intermediate layer comprised of an electrically conductive material disposed in contact with the ground plane of the printed circuit board, the intermediate layer having a through hole corresponding in position to the feed hole on the printed circuit board;

a patch antenna having a first side on which is formed a ground plane comprised of an electrically conductive material, said first side of the patch antenna being disposed in contact with the intermediate layer, and having a second side on which are formed a predetermined number of radiating elements, the patch antenna also having a penetrating feed hole at a position corresponding to that of the through hole in the intermediate layer, for feeding signals to the radiating elements;

an electric conductor passing through the through hole of the intermediate layer without contacting the intermediate layer; one end of the electric conductor being connected with the feed hole of the patch antenna and the other end being connected with the feed hole on the printed circuit board; and a filling insulator, which fills the through hole of the intermediate layer and surrounds the electric conductor therein;

wherein the intermediate layer is disposed between the ground plane of the printed circuit board and the ground plane of the patch antenna to form a grounded electrical potential, and wherein the electric conductor passes through the feed hole of the printed circuit board, the through hole of intermediate layer and the feed hole of the patch antenna perpendicularly, and wherein the through hole acts as an outer conductor and the electric conductor acts as an inner conductor of an equivalent coaxial cable structure that forms a signal path for receive and transmit microwave signals.

2. The device according to claim 1, wherein the intermediate layer is in direct face-to-face contact with the ground plane of the printed circuit board and with the ground plane of the patch antenna and surrounds the electric conductor, such that the heat generated by the transfer of high power microwave signals in the electric conductor, the printed circuit layer and the radiating elements is effectively and rapidly dissipated.

3. The device according to claim 1, wherein the feed hole of printed circuit board is a signal-feeding point for connecting to the printed circuit layer and the feed hole of the patch antenna is a signal-feeding point for connecting to the radiating elements.

4. The device according to claim 2, wherein the feed hole of printed circuit board is a signal-feeding point for connecting to the printed circuit layer and the feed hole of the patch antenna is a signal-feeding point for connecting to the radiating elements.

5. The device according to claim 1, wherein the type of material of the filling insulator, dimension of the through hole of the intermediate layer and dimension of the electric conductor are selected to provide an appropriate characteristic impedance of the coaxial cable structure.

6. The device according to claim 2, wherein the type of material of the filling insulator, dimension of the through hole of the intermediate layer and dimension of the electric conductor are selected to provide an appropriate characteristic impedance of the coaxial cable structure.

7. The device according to claim 1, wherein the filling insulator is comprised of air.

8. The device according to claim 5, wherein the filling insulator is comprised of air.

9. The device according to claim 6, wherein the filling insulator is comprised of air.

10. The device according to claim 1, wherein the filling insulator is comprised of polytetrafluoroethylene (Teflon).

11. The device according to claim 5, wherein the filling insulator is comprised of polytetrafluoroethylene (Teflon).

12. The device according to claim 6, wherein the filling insulator is comprised of polytetrafluoroethylene (Teflon).

13. The device according to claim 1, wherein the printed circuit layer is a first printed circuit layer and the printed circuit board includes at least one additional printed circuit layer.

14. The device according to claim 3, wherein the printed circuit layer is a first printed circuit layer and the printed circuit board includes at least one additional printed circuit layer.

15. The device according to claim 4, wherein the printed circuit layer is a first printed circuit layer and the printed circuit board includes at least one additional printed circuit layer.

* * * * *